US008756768B2

(12) United States Patent
Williams et al.

(10) Patent No.: US 8,756,768 B2
(45) Date of Patent: Jun. 24, 2014

(54) WATERPROOF SLIDE FASTENER

(75) Inventors: Meirion Williams, Cheshire (GB); Steven Thomas, Cheshire (GB); Eiji Gonda, Cheshire (GB)

(73) Assignee: YKK Corporation (JP)

( * ) Notice: Subject to any disclaimer, the term of this patent is extended or adjusted under 35 U.S.C. 154(b) by 89 days.

(21) Appl. No.: 13/186,629

(22) Filed: Jul. 20, 2011

(65) Prior Publication Data

US 2012/0023713 A1 Feb. 2, 2012

(30) Foreign Application Priority Data

Jul. 27, 2010 (GB) ..... 1012592.0

(51) Int. Cl.
*A44B 19/32* (2006.01)

(52) U.S. Cl.
USPC ..... 24/389; 24/398

(58) Field of Classification Search
USPC ..... 24/389, 398, 430
See application file for complete search history.

(56) References Cited

U.S. PATENT DOCUMENTS

| | | | | |
|---|---|---|---|---|
| 2,923,992 | A | 2/1960 | Armstrong et al, | |
| 3,389,441 | A | 6/1968 | Helmut | |
| 3,501,816 | A | 3/1970 | Heimberger | |
| 3,668,745 | A | 6/1972 | Krupp | |
| 3,924,305 | A * | 12/1975 | Hamamura | 24/389 |
| 4,580,321 | A | 4/1986 | Tanikawa et al. | |
| 4,607,416 | A * | 8/1986 | Tanikawa et al. | 24/389 |
| 4,724,586 | A * | 2/1988 | Tsubokawa et al. | 24/384 |
| 4,888,859 | A | 12/1989 | Horita | |
| 6,343,408 | B1 * | 2/2002 | Neugebauer | 24/389 |
| 6,427,294 | B1 | 8/2002 | Shibaike et al. | |
| 6,497,014 | B2 * | 12/2002 | Neugebauer | 24/389 |
| 2009/0139068 | A1 | 6/2009 | Takazawa et al. | |

FOREIGN PATENT DOCUMENTS

| | | |
|---|---|---|
| GB | 1318360 A | 5/1973 |
| GB | 2015642 A | 9/1979 |
| GB | 2158506 A | 11/1985 |
| KR | 20-0322063 | 8/2003 |

OTHER PUBLICATIONS

European Search Report, European Patent Application No. 11174942.0, mailed Jun. 4, 2012.
Office Action, Korean Patent Application No. 10-2011-73953, mailed Nov. 6, 2012.
United Kingdom Search Report, British Patent Application No. 1012592.0, mailed Nov. 19, 2010.

* cited by examiner

*Primary Examiner* — Robert J Sandy
*Assistant Examiner* — David Upchurch
(74) *Attorney, Agent, or Firm* — Kilpatrick Townsend & Stockton LLP

(57) ABSTRACT

A waterproof slide fastener is provided. A pair of tapes has coupling elements attached thereto. A coating of polymeric material is provided on at least one surface of the tape and extends continuously therealong. The coating includes in cross-section a fin with a bulbous region. The coating is not extendable beyond the coupling elements when the slide fastener is in an open arrangement.

10 Claims, 5 Drawing Sheets

WATERPROOF SLIDE FASTENER

The disclosure of UK Patent Application No. 1012592.0 filed on Jul. 27, 2010, including specification, drawings and claims are incorporated herein by reference in their entirety.

The present invention relates to a slide fastener, more particularly the present invention relates to a coil type slide fastener and especially a substantially waterproof or fluid-tight coil type slide fastener.

BACKGROUND

There are many types of fluid-tight slide fasteners wherein a stringer tape supports along one side of each edge a row of continuous coupling elements and on the opposing side a sealing member, thereby creating a waterproof or fluid tight fastening mechanism.

When the fastening or coupling elements are comprised of a continuous coil, the coupling elements are most commonly woven or knitted onto the stringer tape or alternatively are stitched to the tape surface at the edge of the tape.

There is a constant need for slide fasteners which are waterproof and fluid-tight and which can meet the demanding requirements of the modern world where extreme sports activities are ever more accessible to adults and children alike.

When applied to outdoor pursuits garments it is necessary for the slide fastener to be strong, hard wearing and most importantly substantially impervious to fluids. However, the waterproof covering applied to the external surface of the stringer tape is often a weak point in terms of fluid access be it in the form for example of snow, ice, or water-spray.

Prior art teachings have sought to solve this problem and the following slide fasteners have been disclosed.

In U.S. Pat. No. 6,343,408 B1 (YKK Corporation) there is described a pair of fluid-tight slide fastener carrying tapes upon which are located rows of coupling members and which are overlaid by a soft, synthetic rubber or similar covering layer.

The pair of continuous rows of coupling members are sewn to the carrying tapes in a spaced offset position transversely to the longitudinal edges of the carrying tapes such that the press-contact edge portions of the soft covering layers are in contact with one another along a longitudinal plane which intersects the slide fastener at a central axis thereof and which runs at right angles to the slide fastener plane.

The press-contact edge portions of the covering layer project over the longitudinal plane when the coupling member rows are disengaged. However, when the coupling member rows are engaged the edge portions of the covering layer are bent away from the tapes carrying the coupling member rows and are caused to extend roughly at right angles to the slide fastener.

The press-contact edges of the soft covering layers therefore engage one another under pressure when the slide fastener is closed creating a fluid-tight slide fastener, and thereby preventing fluid from passing between the press-contact edges of the soft covering layer.

Unfortunately, a problem exists with this type of slide fastener arrangement in that when the two press-contact edges or sealing lips of the covering layer are brought together it is quite easy to disturb the press-contact edges thereby breaking the fluid tight seal.

The seal may also be readily disturbed or damaged for example in the manufacturing process by bending or creasing the covering layer thereby mis-shaping the sealing zips and the contact edges.

Furthermore, as grease is an essential component in the manufacturing process of such slide fasteners, the application of grease to the covering layer may also result in a ready distortion of the sealing lips or contact edges as the lips are caused to slide over one another. This again leads to a fracture in the abutment of the sealing lips with the resultant ingress of water as one of the lips may slip out of position with respect to the opposing lip. As the use of grease to ease the motion of slide fasteners especially 'heavy duty' slide fasteners is a quite common practice, the misalignment of the sealing lips is a significant issue when preparing fluid tight slide fasteners, an issue which the present application seeks to address.

In U.S. Pat. No. 3,668,745 (Krupp) there is also disclosed a sealing closure or slide fastener having sealing lips for providing a fluid-tight seal over interlocking teeth or coupling elements. In this document the coupling elements do not project beyond the edges of the stringers carrying them in the closed position. Instead, relatively small sealing lips are provided close to the neutral axis of the coupling elements and when the coupling elements are closed the edges of the stringers are turned over bringing together the sealing lips of resilient material and thereby creating a fluid tight seal.

This type of arrangement whilst providing a suitable fluid-tight fastening mechanism is complicated in design and hence much more expensive to manufacture. It also requires a specifically designed shape of coupling element which renders standardized production of the slide fastener more difficult and expensive, especially for larger and more 'heavy-duty' slide fasteners with more rigid tapes.

In U.S. Pat. No. 2,923,992 (Armstrong) there is again described a flexible slide fastener capable of providing a suitable seal against the passing of water, air and other fluids. In the slide fastener described herein there is provided a pair of textile stringers with fastener teeth mounted in series on adjacent edges of said stringers and an impervious layer of material mounted on one side of the stringers.

However, in U.S. Pat. No. 2,923,992 the abutting edges of the impervious layer of material are angled differently with respect to each other such that when the slide fastener is closed the abutting surfaces or sealing lips are at an acute angle with respect to the closed plane of the coupling elements thereby creating an angled abutment. This has the potential for an uneven abutment between the sealing lips and hence an uneven closure mechanism leading to a non-planar arrangement of the sealing lips.

In U.S. Pat. No. 4,580,321 (Yoshida Kogyo K. K.) there is described a fluid-tight slide fastener comprised of a pair of slide fastener stringers joinable along their respective longitudinal edges, with support tape and a row of continuous coupling elements extending longitudinally on the side of the tape. An elastomeric sealing member overlies one side of the tape and has a longitudinal contact edge portion transversely projecting beyond a median plane of symmetry defined by said slide fastener halves in engagement, said plane being perpendicular to a general plane of said elastomeric sealing member.

In U.S. Pat. No. 4,580,321 however, the sealing members on each side of the slide fastener create an uneven and unattractive ridge when the slide fastener is closed and furthermore, due to the blunt nature of the elastomeric sealing member on each side of the tape, the final shape of the sealing member when closed can not be controlled. This can therefore lead to the inherent problems of slippage of the respective sealing members on each side of the tape with the resulting potential ingress of fluid.

In U.S. Pat. No. 3,501,816 (Heimberger) there is disclosed a fluid-tight slide fastener comprising a pair of inter-engageable elastomeric sealing strips wherein the elastomeric material encapsulates the coupling elements on each side of the respective stringer tapes. The slide fastener halves are originally laterally reversed with respect to one another and are interconnected for extrusion of the elastomeric material therearound.

Also disclosed are slide fasteners in which a prominent and strongly projecting tip or rib of elastomeric material is disposed on each side of the stringer tapes. The lips or ribs of elastomeric material extend someway beyond the edge of the coupling elements when the slide fastener is in an open arrangement. Whilst the relatively soft elastomeric lips or ribs do not affect the slider operation on the slide fastener, the abutment of the lips or ribs can not be controlled leading to an uneven abutment with the resultant ingress of fluids.

In U.S. Pat. No. 4,888,859 (Yoshida Kogyo K. K.) there is again described a water-tight slide fastener which comprises a pair of support tapes each coated on one surface with a water resistant material and including a row of coupling elements mounted on each of the tapes along the longitudinal edge.

The spaces or gaps defined by the interdigitation of the rows of coupling elements are completely filled by a filling core which swells when in contact with a liquid and thereby prevents entry of the liquid into a garment to which the fastener is applied.

The filling core is formed from a polymeric fibrous material which is highly water absorptive and capable of swelling upon wetting with water, and which is further highly water retentive against pressure in normal use.

In addition, in one embodiment of U.S. Pat. No. 4,888,859, the slide fastener is concealed and the tapes are coated with a watertight layer on one of the surfaces and include a folded edge portion further comprising waterproof strands which abut at the edges of the opposed tapes.

There is no mention in U.S. Pat. No. 4,888,859 of a coupling mechanism in which the waterproof layer is shaped to specifically ensure that when the edges of the waterproof layer abut there is no slippage and no misalignment of the edges of the sealing lips of the waterproof layer. The ingress of water into the slide fastener in U.S. Pat. No. 4,888,859 is prevented by the presence of waterproof strands which block any gap arising between the tape edges and the watertight layer.

Finally, in U.S. Pat. No. 6,427,294 B1 (YKK Corporation) there is described a waterproof slide fastener wherein a laminated synthetic resin film comprised of a low melting point resin layer and a high melting point resin layer, is fused to an entire surface of at least one face of a fastening tape in the slide fastener such that the lower melting point resin layer is in contact with and opposes the surface of the fastener tape while fastening elements are mounted on a side edge of the fastening tape.

Therefore, the ingress of water is prevented in U.S. Pat. No. 6,427,294 B1 by a multiple layer of resins which in combination provide a waterproof layer. Also in U.S. Pat. No. 6,427,294 the waterproof layer extends around the edges of the tape, and yarns are used which are fused into position to prevent any ingress of water.

There is no mention in U.S. Pat. No. 6,427,294 of a waterproof layer which comprise fins and which is shaped so that it does not extend past the edge of the coupling elements when the fastener is in the open position and which abut to form a substantially planar waterproof layer such that the sealing lips do not move with respect to one another and allow the ingress of water.

SUMMARY

The present invention therefore seeks to overcome the problems associated with the prior art slide fasteners and provide an improved waterproof slide fastener which is capable of enduring extreme weather conditions and handling and yet still remain waterproof and impervious to fluids and in which the waterproofing layer does not interfere with the interdigitation of the coupling elements and furthermore which has improved resistance to manufacturing damage caused by the use of grease in standard manufacturing processes.

In addition, in the present invention, there is provided a slide fastener in which the novel shape of the waterproof layer, and the edges or sealing lips of the waterproof layer and their position with respect to the coupling elements ensures that it is more difficult for grease to interfere with the seal of the sealing lips and hence aims to prevent slippage of the sealing lips with respect to each other during standard manufacturing processes.

Furthermore, if slippage of the sealing lips of the waterproof layer does occur, the arrangement of the sealing lips causes the lips to simply move more closely together thereby ensuring the tightness of the water-proof seal.

The present invention is therefore applicable to waterproof and even fluid impervious slide fasteners but it is not limited thereto.

In addition, it will be appreciated that the slide fasteners of the present invention have a particular application in waterproof garments and garments used for example in outdoor pursuits including for example walking clothes, diving suits, etc and also in waterproof articles for example tents and life rafts, but again the application is not limited thereto.

Therefore according to a first aspect of the present invention there is provided:

a waterproof slide fastener comprising:

a pair of tapes having coupling elements attached thereto, wherein: a coating of polymeric material is provided on at least one surface of the tape and extends continuously therealong; the coating comprises in cross-section a fin with a bulbous region; and the coating is not extendable beyond the coupling elements when the slide fastener is in an open arrangement.

Also in accordance with the present invention there is provided a waterproof slide fastener comprising:

a pair of tapes having coupling elements attached thereto, wherein:

a coating of polymeric material is provided on at least one surface of the tape and extends continuously therealong; the coating comprises in cross-section a fin with a bulbous region;

the fins on each side of the slide fastener abut to form a seal comprising a first start point and a second end point; and the length between the first start point and the second end point of the seal is greater than the distance between a boundary point of an end edge of the tape at a side of the coupling elements and the coating and the first start point of the seal when the slide fastener is in a closed arrangement.

It is preferred that the coating of the polymeric material is extruded onto the tape however, the coating of the polymeric material may be applied by alternative methods. In addition, the coating of the polymeric material may be further adhered to the tape. Any suitable adhesive may be employed for this purpose.

The coupling elements comprise a first upper portion and a second lower portion. The first upper portion of the coupling elements is closest to the coating of the polymeric material.

Also in accordance with the present invention, the fin of the coating on each side of the tape comprises a first rising portion extending away from the coupling elements in a tape front and back direction from an end edge of the tape as a start point, a second top portion being continuous to the first rising portion and a third return portion being continuous to the second top portion and extending away from the coupling elements in a tape width direction. The first rising portion of the fin commences at a start point where the tape ends.

In the waterproof slide fastener according to the present invention, the coupling elements comprise a first upper portion and a second lower portion and wherein the first upper portion of the coupling elements is closer to the coating of the polymeric material than the second lower portion. In addition, the distance between the first upper portion of the coupling elements and the start point of the first rising portion of the fin, which starts at the start point where the tape ends, is less than 25% of the distance between the first upper portion and the second lower portion of the coupling elements. That is, less than 25% of the depth of the coupling elements. More preferably the distance between the first upper portion of the coupling elements and the start point of the first rising portion of the fin, which starts at the start point where the tape ends, is less than 20%.

It is also preferred that the coating of polymeric material forming the fin is provided on at least one surface of the tape and extends continuously therealong and also extends over the edge of the fabric tape distal the coupling elements. The fin shaped coating of the polymeric material may also extend to a second surface of the tape.

According to the first aspect of the present invention, the fin shaped coating of the polymeric material comprises a bulbous region formed in the fin so as to expand at a side of the coupling elements and a neck region having a substantially uniform thickness. The polymeric material may be a thermoset but is preferably comprised of thermoplastic and most preferably comprises polyurethane or polychloroprene. The polymeric material may also be transparent.

The fin of the coating on at least one side of each tape abuts at a centre line of the slide fastener to form a seal. The seal comprises an abutment of the sealing lips of the fin. In addition, an upper surface of the abutting fin, located on at least one side of each tape is aligned with respect to the surface of each tape. The coating of the polymeric material may be thicker on the one surface of the tape than on the second surface of the tape.

It is also preferred that the waterproof slide fastener according to the present invention is applied to a coil type slide fastener. The coil type slide fastener is preferably comprised of nylon. The slide fastener may also comprise a hydrophobic treatment, or alternatively, the tapes may be comprised of hydrophobic material. Each tape is preferably comprised of fabric.

According to a second aspect of the present invention there is provided a method of applying a fluid tight coating to a fastener tape according to the first aspect of the present invention wherein the method comprises the steps of feeding the tape having coupling elements attached thereto through an extrusion die and extruding a layer of polymeric material onto at least one side of the tape to form a fluid tight slide fastener, wherein the fin of the layer of the polymeric material is extruded to prevent the ingress of fluid.

According to a third aspect of the present invention, a fluid tight slide fastener as described in relation to the first or second aspects of the present invention is used for clothing, tents, life rafts and luggage.

Other aspects of the preferred features of the present invention will become apparent from the following description and accompanying claims.

According to the present invention, it is possible to endure extreme weather conditions and handling and yet still remain waterproof and impervious to fluids, to prevent the waterproofing layer from interfering with the interdigitation of the coupling elements, to improve resistance to manufacturing damage caused by the use of grease, to ensure that it is more difficult for grease to interfere with the seal of the sealing lips, and to prevent slippage of the sealing lips with respect to each other during standard manufacturing processes.

DETAILED DESCRIPTION OF THE EMBODIMENTS

The invention will now be further described by way of example and with reference to the accompanying drawings.

Figure 1:
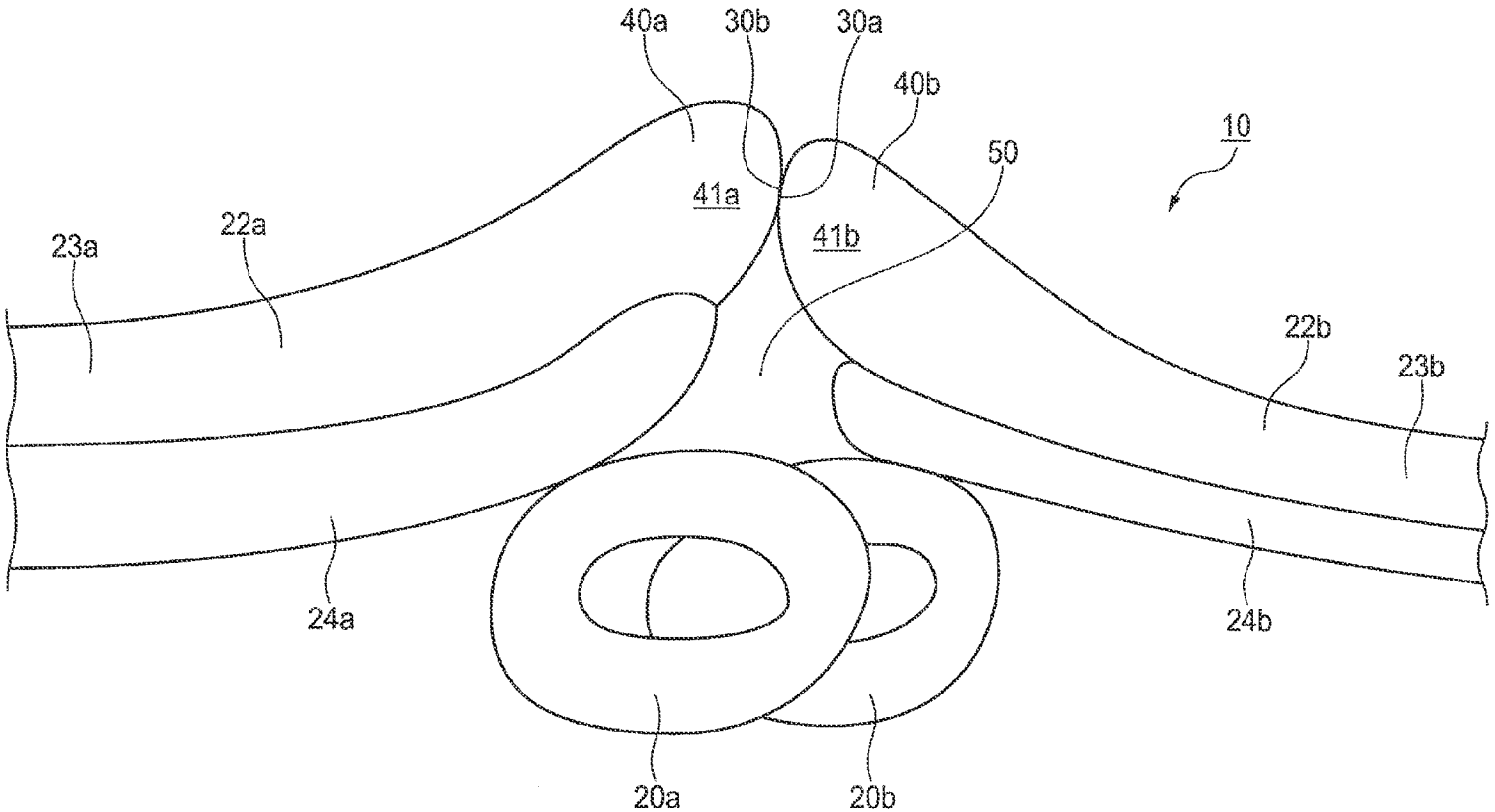
Prior Art FIG.1
FIG. 1 is a sectional view of a prior art slide fastener in the closed position.

In FIG. 1 there is disclosed a sectional view of a prior art coil type slide fastener 10 in which waterproof layers 22*a* and 22*b* are formed at one side of a pair of tapes 24*a* and 24*b*, and coil type coupling elements 20*a* and 20*b* are mounted at the other side.

Each of the coil type coupling elements 20*a* and 20*b* is formed by coiling a synthetic resin monofilament. Each of the coupling elements is comprised of an engaging portion which engages with an opposite coupling element, upper and lower leg portions, and a turnover portion. The coupling elements 20*a* and 20*b* are stitched to the tapes 24*a* and 24*b* with a sewing thread or woven or knitted onto the tape 24*a* and 24*b* at the time of the knitting or the weaving of the tapes 24*a* and 24*b*.

In FIG. 1 the coupling elements 20*a*, 20*b* are engaged with each other and the slide fastener 10 is therefore closed. In the following description, a direction parallel to a horizontal surface of the tapes 24*a* and 24*b* and perpendicular to a longitudinal direction of the tapes 24*a* and 24*b* is referred to as a tape width direction and a direction vertical to the horizontal surface is referred to as a front and back direction.

The coupling elements 20*a*, 20*b* are attached to opposite edges of the pair of tapes 24*a* and 24*b* respectively, and the waterproof layer 22*a* and 22*b* is applied atop the tapes 24*a* and 24*b*.

The waterproof layer 22*a* and 22*b* extends along the length of the slide fastener 10 and in cross-section can be seen to have a substantially uniform elongate profile or neck region 23*a*, 23*b* outside of fin shaped ends 41*a* and 41*b* (a direction away from the ends in the tape width direction) on each side of the tapes 24*a* and 24*b* to form fin shaped protrusions 40*a* and 40*b*. When the slide fastener 10 is in the closed position as shown in FIG. 1, sealing lips 30*a*, 30*b* (abutting lips) located on the opposite side of the tapes 24*a* and 24*b* to which the coupling elements 20*a*, 20*b* are applied are formed on the fins 40*a* and 40*b* and the sealing lips 30*a* and 30*b* come in contact with each other.

As shown in FIG. 1 however, a problem exists with the shape of the waterproof layers 22*a* and 22*b* in that when the slide fastener 10 is closed and the coupling elements 20*a* and 20*b* are in an interdigitating relationship, the sealing lips 30*a* and 30*b* are not perfectly aligned such that the first fin 40*a* is seen to be raised with respect to the second fin 40*b*.

As a consequence, when viewed in cross-section, the waterproof layers 20*a* and 20*b* of the slide fastener 10 do not form a flat surface, and do not effectively exert the waterproof property. This misalignment of the sealing lips 30*a* and 30*b* or fins 40*a* and 40*b* leads to problems with the opening and closing of the slide fastener 10. In addition, the non-uniform meeting of the sealing lips 30*a* and 30*b* on the fins 40*a* and 40*b* allows for the ingress of water such that the slide fastener 10 can no longer exert the waterproof property. This uneven surface of the waterproof layers 22*a* and 22*b* can also lead to problems when opening and closing the slide fastener 10 as it will be difficult to pass a slider (not shown) over the uneven surface of the waterproof layers 22*a* and 22*b* and thereby close or open the slide fastener 10.

In addition, when manufacturing the slide fastener 10 (the zip fastener) with a waterproof layers 22*a* and 22*b* as in FIG. 1, oil and/or grease is/are often employed to ease the sliding of the slider. However, the use of oil and/or grease may often lead to the fins 40*a* and 40*b* and sealing lips 30*a* and 30*b* being either damaged, folded over or misaligned in use, which may lead to ingress of fluid through the seal. Without wishing to be bound by any particular theory, it can be surmised that it is the shape and thickness of the elongate neck regions 23*a* and 23*b* and the fins 40*a* and 40*b*, which leads to the neck regions 23*a* and 23*b* and the fins 40*a* and 40*b* being misaligned during the slide fastener 10 manufacturing process and the misalignment of the sealing lips. The elongate neck regions 23*a* and 23*b* of the fins 40*a* and 40*b* are of substantially the same thickness up to the end portion 41*a* and 41*b* provides sufficient flexibility in the neck regions 23*a* and 23*b* for the waterproof layers 22*a* and 22*b* to allow the layers to flex and bend towards the coupling elements 20*a* and 20*b*.

Figure 2:
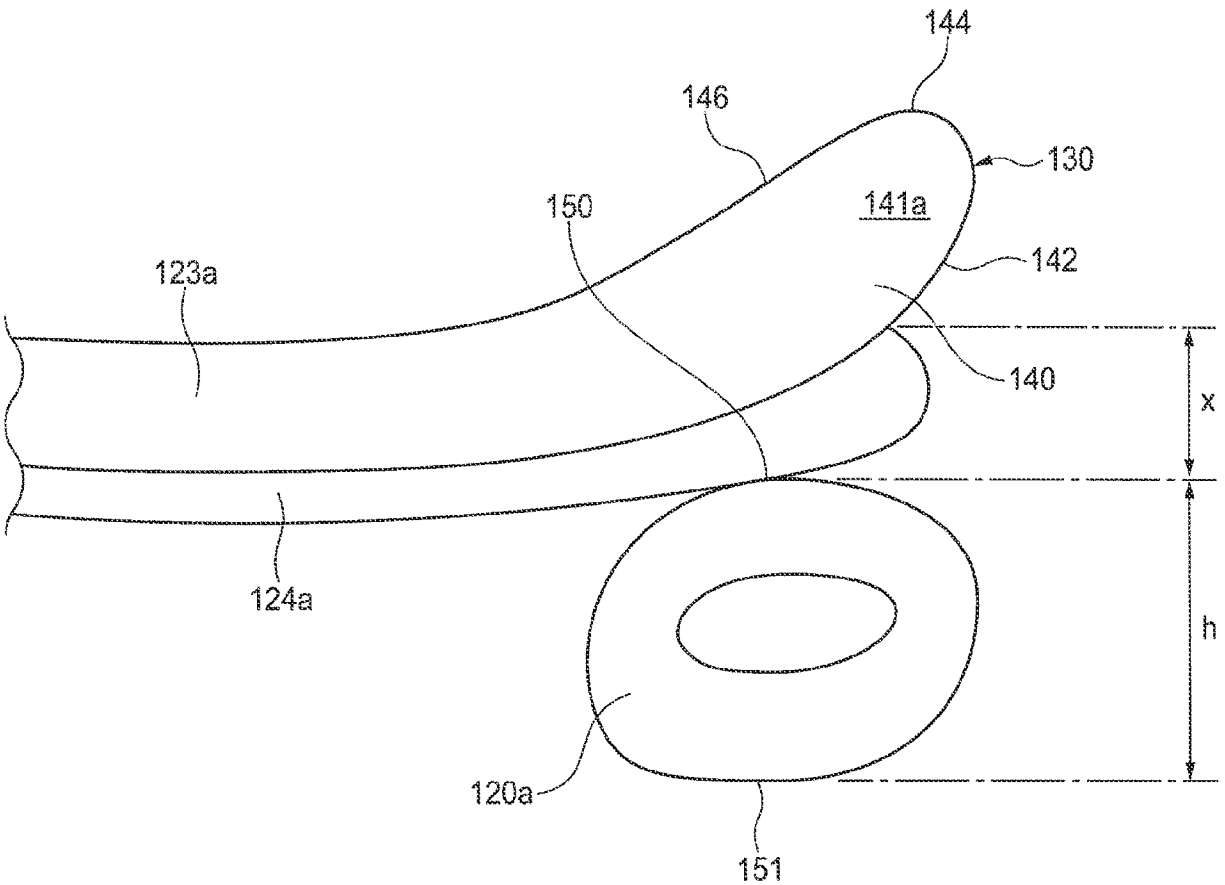
Prior Art FIG. 2
FIG. 2 is a sectional view of one half of a prior art slide fastener.

In FIG. 2 there is illustrated an enlarged cross-sectional view of one side (left side in FIG. 1) of the slide fastener 10 seen in FIG. 1, with a fin shaped waterproof layer 140 adhered to the top of a tape 124*a* to which is attached coupling element 120*a*.

The fin (the waterproof layer) 140 comprises a rising portion 142 extending away from the coupling element 120*a* in the front and back direction (i.e. the front direction) from an edge of the tape 124*a*, a rounded top portion 144 being continuous to the rising portion 142, and a return portion 146 being continuous to the rounded top portion 144 and extending away from the coupling element 120*a* in the horizontal direction. As shown in FIG. 2, the waterproof layer 140 comprises an elongate neck region 123*a* which terminates in the end 141*a* of the fin 140. However, the fin 140 comprises a substantially uniform cross-sectional profile prior to the termination of the fin 140 at the sealing lip 130*a*. It can also be seen from FIG. 2 that whilst the end 141*a* of the fin 140 terminates in line with the coupling element 120*a* in cross-section, if the waterproof fin 140 were to be pressed in a downward direction towards the coupling elements 140*a*, then the region of the sealing lip 130*a* would extend beyond the end of the coupling element 120*a*.

The rising portion 142 of the fin 140, starting where the tape 124*a* ends, is a set distance above the top edge 150 of the coupling element 120*a*, such that there is a distance denoted by 'x' between the top (top edge 150) of the coupling element 120*a* and the start point of the rising portion 142 of the fin 140 where the tape 124*a* ends. The distance 'x' between the top (top edge 150) of the coupling element 120*a* and the start point of the rising portion 142 of the fin 140 is close to half the height 'h' of the coupling element 120*a* as measured between the top edge 150 (the first upper portion) of the coupling element 120*a* and the bottom 151 (the second lower portion) of the coupling element 120*a*. The top edge 150 in cross-section is a peak portion of the coupling element 120*a* at a side of the tape 124*a* and the bottom 151 in cross-section is a peak portion of the coupling element 120*a* at an opposite side to the tape 124*a*.

This distance 'x' ensures that when the coupling elements 20*a* and 20*b* interdigitate as shown in FIG. 1, there is a void 50 created by the joining (engaging) of the waterproof layer 22*a* and 22*b* and the coupling elements 20*a* and 20*b*. This void 50 is of a significant size (a size in cross-sectional view of FIG. 1) with respect to the size (a size in cross-sectional view of FIG. 1) of the slide fastener 10. Therefore if the misaligned fins 40*a*, 40*b* are caused to slip further by the presence of addition oil and/or grease on the edges of the sealing lips 30*a* and 30*b*, there is sufficient space in the slide fastener 10 due to the void 50, providing for additional movement of the fins 40*a* and 40*b* with respect to one another, and hence further misalignment of the fins 40*a* and 40*b* with respect to one another can occur. This ultimately leads to a slide fastener 10 with an even more pronounced uneven water-proof layers 22*a* and 22*b*. In addition, the substantially uniform thickness of the neck regions 23*a* and 23*b* of the waterproof layers 22*a* and 22*b* has the effect that there is sufficient flexibility in the waterproof layers 22*a* and 22*b* to allow the fins 40*a* and 40*b* to move with respect to one another and into the void (space) 50 formed when the slide fastener 10 is closed.

Figure 3:
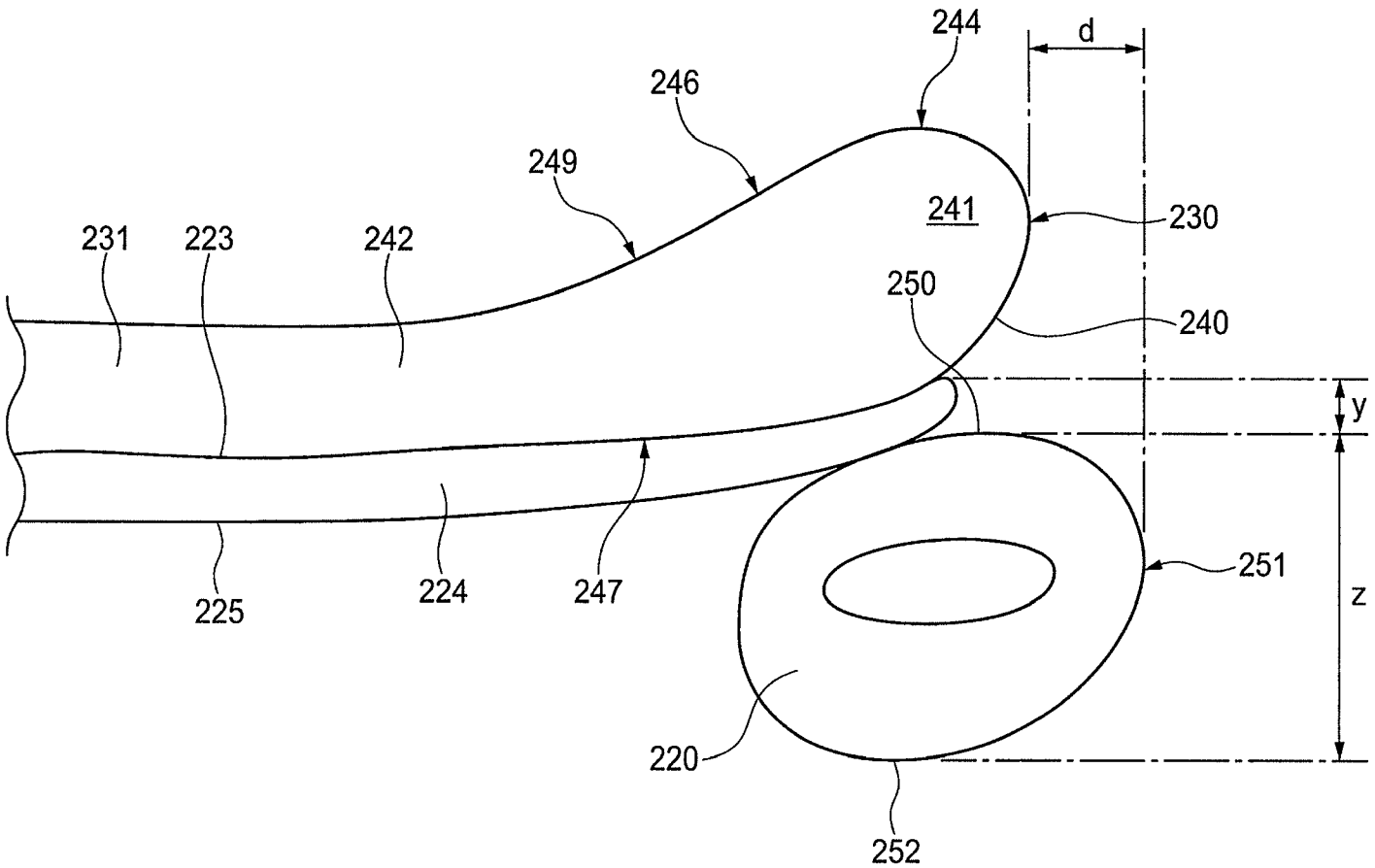
FIG. 3 is a sectional view of one half of a slide fastener according to the present invention.

In FIG. 3 which illustrates a cross-sectional view of one side of a slide fastener with a coupling element 220, and fin shaped waterproof layer 242 in accordance with the present invention, it can be seen that whilst the fin 230 has a neck region 231 which has substantially of a uniform thickness for a part of the fin 230, the neck region 231 also extends outwardly both towards and away from the coupling elements 220 at a lower surface 247 and an upper surface 249 of the fin 230 at a side of the coupling element 220 in FIG. 3 respectively, to form a bulbous end 241 which terminates in the sealing lip of the fin 230. In cross-section, the bulbous end (bulbous region) 241 is formed such that the thickness thereof is gradually increase from the thickness of the neck region 231 toward the coupling element 220 and thus the bulbous end 241 can be seen as a bulb shape. The first upper portion 250 is also referred to as the top edge and the second lower portion 252 is also referred to as the bottom Consequently the rising portion 240 of the fin 230 is formed from end edge of the tape 224 at which the tape 224 terminates in cross-section, and the distance 'y' between the rising portion 240 at the side of the tape end edge and the top edge 250 of the coupling element 220 is greatly shorter than the distance between the top edge 250 and the bottom 252 of the coupling elements 220, which is denoted by 'z'. The fin 230 of the waterproof layer 242 still comprised of a rising portion (first rising portion) 240 extending away from the coupling element 220 in the front and back direction (i.e. the front direction) from a position where the tape 224 ends (the end edge of the tape 224) as a start point, a rounded top portion (second top portion) 244 being continuous to the rising portion 240, and a return portion 246 being continuous to the rounded top portion 244 and extending away from the coupling element 220 in the horizontal direction, and the coupling element 220 is still secured to a tape 224, however, it can be seen in FIG. 3 that the fin 230 does not protrude beyond the end edge 251 of the coupling element 220, in the open state of the slide fastener. In addition, even if one were to press the fin 230 towards the coupling element 220, the fin 230 could still not be forced to extend beyond the end (side edge 251) of the coupling element 220. It can be seen from FIG. 3 that there is a distance 'd' between the sealing lip of the fin 230 and the side edge 251 of the coupling element 220. When the coupling elements 220 of each tape 224 are engaged with each other and the slide fastener is closed, the fins 230 at each side abuts and are deformed to protrude away from the coupling elements 220 in the front and back direction, but with the distance 'd', the protrusion amount thereof is smaller than that of the prior art slider fastener as shown in FIG. 1. That is, in accordance with the present invention, the variation in height in the front and back direction of the sealing lip of the fin 230 prior to and after the engagement can be decreased compared with the prior art and thus it is possible to prevent the slippage of the sealing lip.

In addition, the distance 'y' between the rising portion 240 of the fin 230 and the top edge 250 of the coupling element 220, is reduced by around 50% compared to the prior art arrangement illustrated in FIG. 2 such that the distance 'y' is less than 25% of the height 'z' of the coupling element 220 as measured between the top edge 250 and the bottom 252 of the coupling elements 220. Even more preferred, the distance 'y' is less than 20% of the height 'z' of the coupling element 220 because it becomes possible to decrease in size the void in a state where the coupling elements 220 engage with respect to the size of the slide fastener, as compared to the prior art.

The coating of polymeric material forming the fin 230 extends continuously along one surface 223 of the tape 224 and may also extend over the edge of the fabric tape 224 away from the coupling elements 220. Consequently, the coating of polymeric material forming the fin 230 may also extend along the second surface of the tape 224, i.e. the back surface 225.

Figure 4:
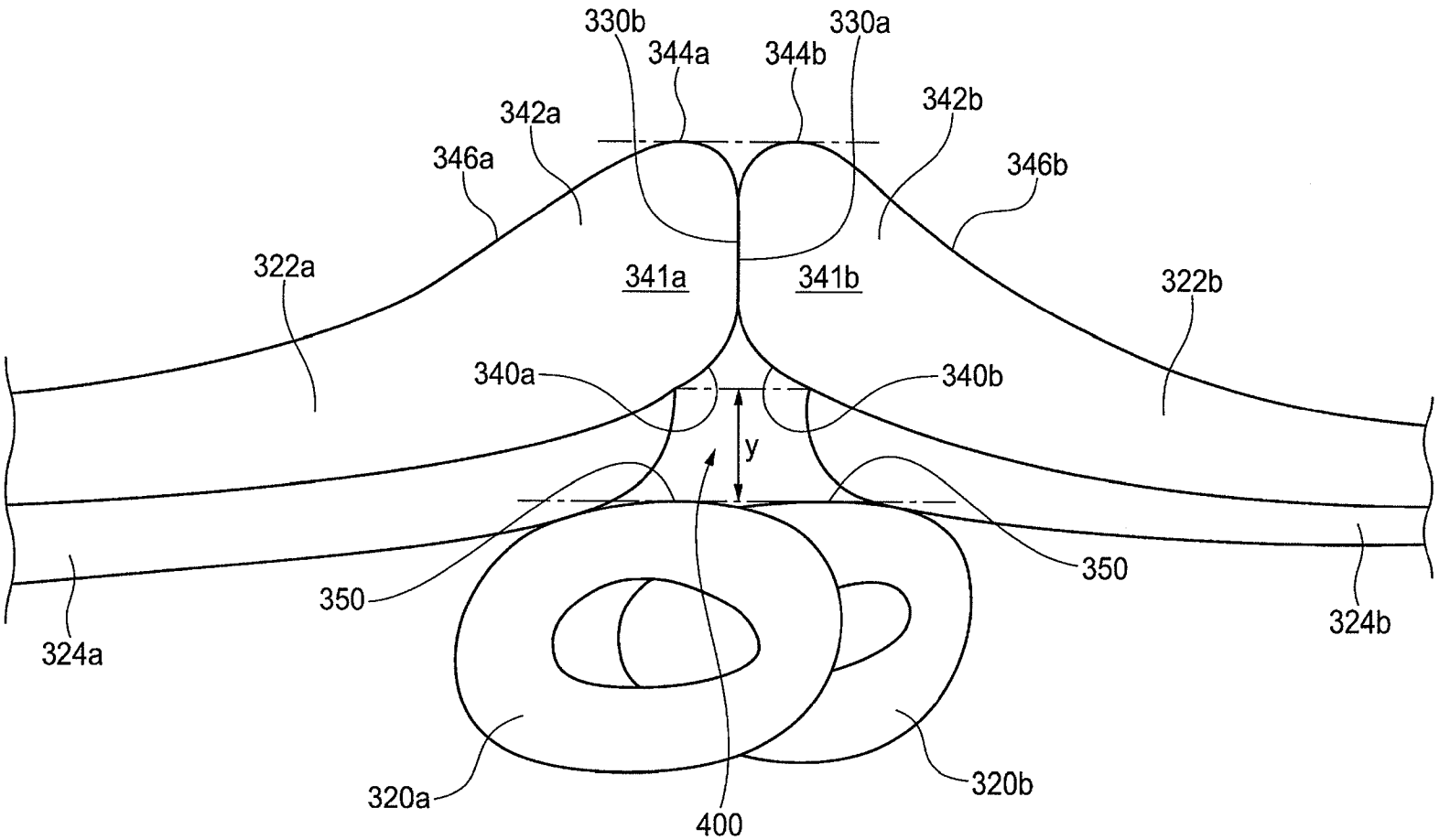
FIG. 4 is a sectional view of the slide fastener in the closed position according to the present invention.

In FIG. 4 there is illustrated a cross-sectional view of the slide fastener according to the present invention in closed state with the coupling elements 320*a*, 320*b* in an interdigitating relationship. In FIG. 4, the slide fastener comprises coupling elements 320*a* and 320*b* attached to opposite edges of the tapes 324*a* and 324*b*, respectively. Located atop the tapes 324*a*, 324*b* are waterproof layers 322*a* and 322*b*, respectively.

In FIG. 4 however it can be seen that the fins 342*a*, 342*b* while possessing rising portions (the first rising portion) 340*a* and 340*b* starting at the points (tape end edges) at which the tapes 324*a*, 324*b* end, top portions (the second top portion) 344*a* and 344*b* being continuous to the rising portions 340*a* and 340*b*, and return portions 346*a* and 346*b* being continuous to the top portions 344*a* and 344*b* and extending away from the top portions 344*a* and 344*b* in the horizontal direction, that the topmost part of the fins 342*a* and 342*b* at the top portions 344*a* and 344*b* are aligned without slippage with respect to each other. In addition, the sealing lip edges 330*a* and 330*b* are also aligned. Most importantly however the void 400 created between the top edge 350 of the coupling elements 320*a* and 320*b* and the rising portions 340*a* and 340*b* of the fins 342*a* and 342*b* is decreased in volume. This is because the distance 'y' between the top edge 350 of the coupling elements 320*a* and 320*b* and the start point of the rising portions 340*a* and 340*b* of the fins 342*a* and 342*b* has decreased in length when compared with the slide fasteners of the prior art.

This decrease in the volume of the void 400 is also due to the fact that the fins 342*a* and 342*b* are comprised of a bulbous ends (bulbous regions) 341*a* and 341*b* prior to the seal (the edges 330*a* and 330*b* of the sealing lips) which extends into the region forming the void 400 (in a distance from the upper portions 344*a* and 344*b* toward the return portion 346*a* and 346*b*). The bulbous ends 341*a* and 341*b* is formed such that the thickness thereof in cross-section is gradually increased from the thickness of the neck region toward the coupling elements 320*a* and 320*b*, the front surfaces of the fins 342*a* and 342*b* are away from the coupling elements 320*a* and 320*b*, and the surfaces at a side of the tapes 324*a* and 324*b* spread toward the coupling elements 320*a* and 320*b*, to form an expanded shape. And the fins 342*a* and 342*b* are formed with regions of the bulbous ends 341*a* and 341*b* at expanded portions compared with the neck region having uniform thickness. The bulbous regions 341*a* and 341*b* provide a greater abutment area between the sealing lips of the fins 342*a* and 342*b*. In addition, the expanding nature of the waterproof layers 322*a* and 322*b* creating the bulbous regions 341*a* and has the further effect that the waterproof layers 322*a* and 322*b* are thickened in the bulbous region 341*a* and 341*b* and therefore also strengthened.

Consequently, the bulbous fins 342*a* and 342*b* are less prone to slipping with respect to one another and readily align.

Figure 5:
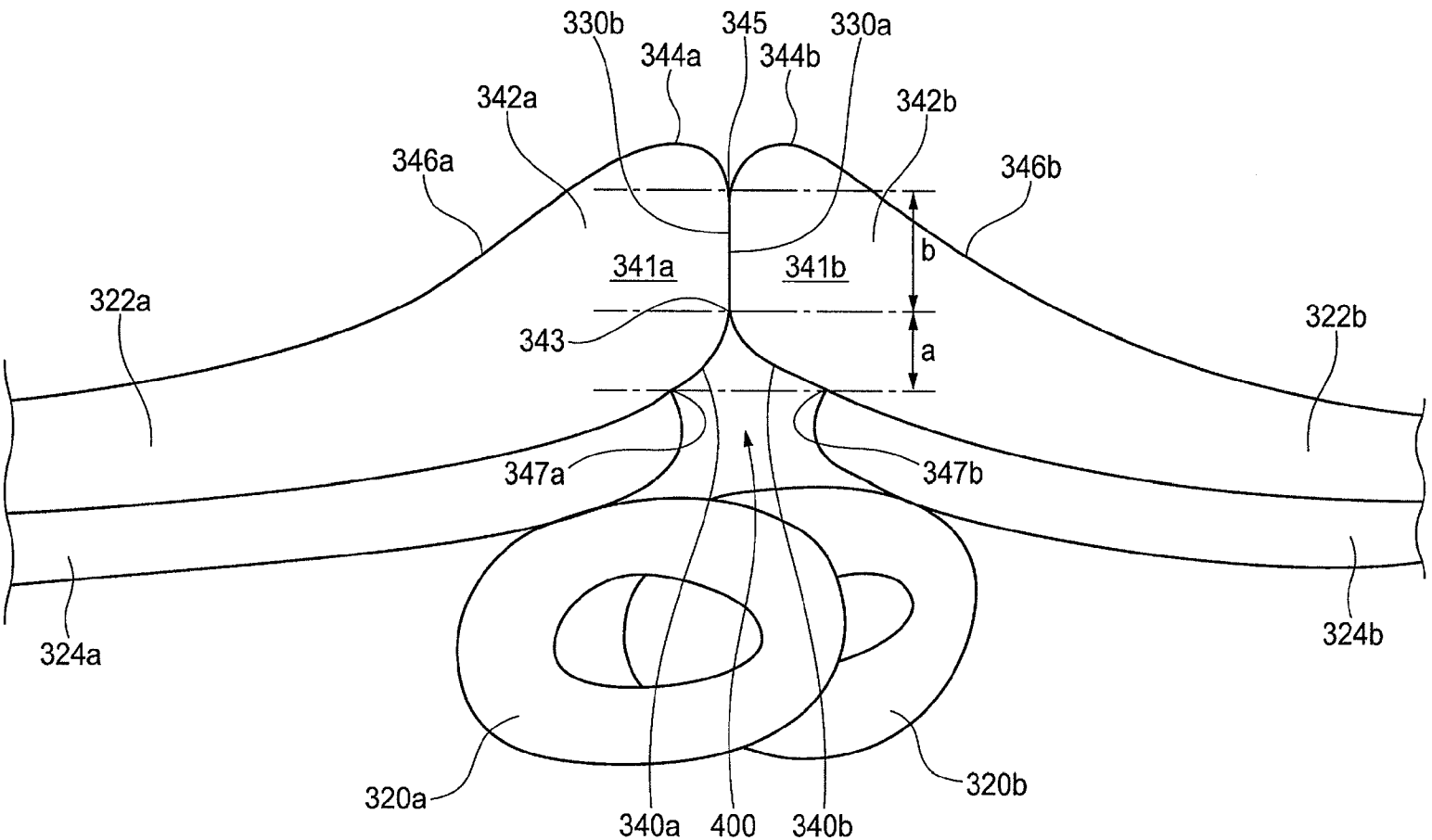
FIG. 5 is an additional view of the slide fastener in the closed position according to the present invention as illustrated in FIG. 4.

FIG. 5 there is illustrated an additional view of the slide fastener in the closed position according to the present invention as illustrated in FIG. 4 in which like members are numbered accordingly. It can be seen that an additional feature of the slide fastener of the present invention resides in the shape of the fins 342*a*, 342*b*. The fins 342*a* and 342*b* are designed so that when pressure is applied to the return portions 346*a*, 346*b*, edges 330*a* and 330*b* of the sealing lips come in contact with each other to form a seal. The contact length of the edges 330*a* and 330*b* of the sealing lips defined by distance 'b' between a first starting point 343 and a second end point 345 increases compared with the prior art as shown in FIG. 1, where the first starting point 343 is a contact point between the edges 330*a* and 330*b* at a side of the coupling elements 320*a* and 320*b* and the second starting point 345 is a contact point between the edges 330*a* and 330*b* at a side away from the coupling elements 320*a* and 320*b* relative to the first starting point 343.

Furthermore, in accordance with the present invention, the distance 'a' between a contact point of the upper surface of the fabric tape 324*a* and 324*b*, closest to the edges 330*a* and 330*b* of the sealing lip of the fins 342*a* and 342*b* and the rising portions 340*a* and 340*b* of the fins 342*a* and 342*b* (the boundary point between the tape end edges at a side of the coupling elements 320*a* and 320*b* where the tapes 324*a* and 324*b* end and the waterproof layers 322*a* and 322*b*), and the first starting point 343 of the seal formed by the sealing lips is less than the length of the seal between the sealing lips. The length of the seal is denoted by distance 'b' and measured between the first starting point 343 and the second starting pint 345. That is, the seal is the length of the contact portion of the sealing lips. In accordance with the present invention, the length 'b' of the seal formed by the sealing lips will always be greater than the distance 'a' formed between the uppermost surface of the fabric tapes 341*a*, 341*b*, closest to the waterproof layers 322*a* and 322*b* (the contact points 347*a* and 347*b*) and the first starting point 343 of the seal 343, and therefore the fins 342*a* and 342*b* is formed into the bulbous shape.

It will be further appreciated that whilst the fins 342*a* and 342*b* illustrated in FIGS. 4 and 5 illustrate sloping return portions, 346*a*, 346*b*, the shape of the return portions 346*a* and 346*b* of the fins 342*a* and 342*b* may be modified so as to accommodate any logo or design. For example, the return portions 346*a* and 346*b* of the fins 342*a* and 342*b* may create a less rounded and more angular arrangement.

This aligned arrangement of the upper portions 344*a*, 344*b* of the fins 342*a* and 342*b* and the sealing lips or abutment edges 330*a*, 330*b*, creates advantages with the slide fastener of the present invention compared with prior art slide fasteners and does not pose a problem for sliders passing over the waterproof layers 322*a* and 322*b* and coupling elements 320*a* and 320*b*. For example, when using oil and grease which is required to enable the more ready processing of slide fasteners with a waterproof layer, the aligned coupling elements 320*a*, 320*b* and fin edges 330*a*, 330*b*, ensures that the edge 330*a* of the first fin 342*a* on one side of the slide fastener, does not slip with respect to the edge 330*b* of the second fin 330*b* on the opposing side of the slide fastener and the fin edges 330*a*, 330*b* do not fold over. This creates an improved abutment between the fin edges 330*a*, 330*b* and hence prevents the ingress of water.

It has also been found that by producing the slide fastener according to the present invention in which the fins 342*a*, 342*b* are much more bulbous and closer to the top edges of the coupling elements 320*a*, 320*b*, the slide fastener still has the required flexibility of the product but the fin is not easily deformed compared with the conventional arrangement. Whilst not being bound by any particular embodiment, it is assumed that since the void 400 between the top edges of the coupling elements 320*a* and 320*b* and the rising portions 340*a* and 340*b* of the fins 342*a* and 342*b* commencing at the end edge of the tapes 324*a* and 324*b*, is decreased, and the effective strength of the fins 342*a* and 342*b* are increased due to the thickness of the neck region of the fins 342*a* and 342*b* increasing as one moves along the fins 342*a* and 342*b* towards the coupling elements 320*a* and 320*b* to form the bulbous ends 341*a* and 341*b*, the ability for the fins 342*a* and 342*b* to slide with respect to one another is also reduced.

Consequently the fin shaped coating of the polymeric material according to the present invention address all of the problems associated with prior art waterproof slide fasteners.

As typical examples of the polymeric material, there is thermoplastic elastomer such as polychloroprene, polyurethane elastomer, and polyester elastomer. The polymeric material may be rubber. The polymeric material is formed on the tape surface in the form of a layer. Depending on the polymeric material, a position where the polymeric material is formed can be made to be impermeable to water and air. Accordingly, by applying the coating of the polymeric material on the tape, the tape can be made to be fluid-tight. Further, since the polymeric material at each side has a fin shape, the polymeric material form a seal when the slide fastener is closed, thereby forming liquid-tight state using mating surfaces of the polymeric material. The polymeric material may be transparent. It is preferred that the polymeric material is extruded onto the tape however, the polymeric material may be formed by alternative methods. In addition, the polymeric material may be further adhered to the tape. Any suitable adhesive may be employed for this purpose. The fabric tape may comprise a waterproof or hydrophobic treatment, or alternatively, the sewing thread used for weaving or knitting the tape may be made of hydrophobic material. As an example of the waterproof or hydrophobic treatment, water repellent agent may be applied. The polymeric material may be subjected to the hydrophobic treatment.

The invention claimed is:

1. A waterproof slide fastener comprising:

a pair of tapes;

a plurality of coupling elements attached to one side of the pair of tapes; and a pair of coatings of polymeric material provided on an other side of the pair of tapes, respectively, and extending continuously along a longitudinal direction of the pair of tapes, wherein when the waterproof slide fastener is in an open state, when seen in a cross-sectional view taken along a width direction of the pair of tapes, each of the coatings gradually increases in thickness thereof toward the coupling elements to comprise a fin with an expanded shape, when the waterproof slide fastener is in the open state, when seen in the cross-sectional view taken along the width direction of the pair of tapes, each fin comprises a rising portion extending away from the coupling elements in a front and back direction of the pair of tapes from an end edge of each of the tapes as a start point, a top portion being continuous to the rising portion and a return portion being continuous to the top portion and extending away from the coupling elements in the width direction of the pair of tapes, and when the waterproof slide fastener is in the open state, when seen in the cross-sectional view taken along the width direction of the pair of tapes, the coupling elements attached to one of the tapes separate from the coupling elements attached to the other of the tapes, each of the coatings extends beyond an end edge of the respective tapes, each of the coupling elements extends beyond an end edge of the respective coatings which is defined between the rising portion and the top portion, in the width direction of the pair of tapes, the coupling elements attached to one of the tapes extend beyond the end edge of one of the coatings on the one of the tapes, and the coupling elements attached to the other one of the tapes extend beyond the end edge of the other one of the coatings on the other one of the tapes.

2. The waterproof slide fastener according to claim 1, wherein each of the coatings is adhered to the respective tapes.

3. The waterproof slide fastener according to claim 1, wherein:

when the waterproof slide fastener is in the open state, when seen in the cross-sectional view taken along the width direction of the pair of tapes, each of the coupling elements comprises an upper portion and a lower portion;

the upper portion of each of the coupling elements is positioned closer to each of the coatings than the lower portion; and the distance between the upper portion of each of the coupling elements and the start point of the rising portion of each fin is less than 25% of the distance between the upper portion and the lower portion of each of the coupling elements.

4. The waterproof slide fastener according to claim 1, wherein the pair of coatings extends on the one side of the pair of tapes, respectively.

5. The waterproof slide fastener according to claim 1, wherein when the waterproof slide fastener is in the open state, when seen in the cross-sectional view taken along the width direction of the pair of tapes, each of the coatings comprises a bulbous region formed in the fin so as to expand at a side of the coupling elements and a neck region having a substantially uniform thickness.

6. The waterproof slide fastener according to claim 5, wherein the thickness of the bulbous region is greater than the thickness of the neck region.

7. The waterproof slide fastener according to claim 1, wherein the fin of one of the coatings abuts against the fin of the other of the coatings at a centre line of the waterproof slide fastener to form a seal comprising sealing lips of the fins.

8. The waterproof slide fastener according to claim 7, wherein upper surfaces of the abutting fins are aligned with respect to a plane of the waterproof slide fastener.

9. The waterproof slide fastener according to claim 1, wherein the waterproof slide fastener is a coil type slide fastener in which the coupling elements are coil type coupling elements.

10. The waterproof slide fastener according to claim 1, wherein the pair of tapes comprise a hydrophobic treatment.

* * * * *

UNITED STATES PATENT AND TRADEMARK OFFICE

CERTIFICATE OF CORRECTION

PATENT NO. : 8,756,768 B2
APPLICATION NO. : 13/186629
DATED : June 24, 2014
INVENTOR(S) : Meirion Williams et al.

It is certified that error appears in the above-identified patent and that said Letters Patent is hereby corrected as shown below:

In the Specification

In column 6, line 19, delete "invention." and insert -- invention; --, therefor.

In column 8, line 46, delete "bottom" and insert -- bottom. --, therefor.

Signed and Sealed this
Seventh Day of October, 2014

Michelle K. Lee

Michelle K. Lee
*Deputy Director of the United States Patent and Trademark Office*